US005732812A

United States Patent [19]

Grainger et al.

[11] Patent Number: 5,732,812

[45] Date of Patent: Mar. 31, 1998

[54] ELECTRICAL POWER CONTROL SYSTEM FOR PARKING METER

[75] Inventors: Rodney Grainger, Bedfordview; Andries Jacobus Coetzee, Pretoria; Daniel Nicolaas Paul Ferreira, Johannesburg, all of South Africa

[73] Assignee: International Parking Systems (Proprietary) Limited, Bedfordview, South Africa

[21] Appl. No.: 430,371

[22] Filed: Apr. 28, 1995

[30] Foreign Application Priority Data

Apr. 29, 1994 [ZA] South Africa ..... 94/2947

[51] Int. Cl.[6] ..... G07F 17/24

[52] U.S. Cl. ..... 194/217; 340/932.2; 368/90

[58] Field of Search ..... 194/217, 218; 368/7, 90, 92; 340/932.2

[56] References Cited

U.S. PATENT DOCUMENTS 3,999,372 12/1976 Welch et al. ..... 368/90 X 4,379,334 4/1983 Feagins et al. ..... 368/90 X 4,823,928 4/1989 Speas ..... 194/217

5,442,348 8/1995 Mushell ..... 194/217 X

*Primary Examiner*—F. J. Bartuska

*Attorney, Agent, or Firm*—Sughrue, Mion, Zinn, Macpeak & Seas, PLLC

[57] ABSTRACT

A token operable electronic parking meter 10 is disclosed and claimed. The meter comprises a first power source 18 and a controller 16 for controlling electronic circuity 20, 22 of the parking meter. An interface circuit 14 is connected to the first power source 18 for controlling provision of power from the first power source to the controller. In use, the controller is normally not connected to a power source, but is connectable to the first power source 18 via a first switch $S_1$ which is controllable by the interface circuit 14. The meter 10 further comprises an independently powered timer 38 generating a signal when the controller 18 requires power. The interface circuit 14 is sensitive to a signal from the timer 38 and is arranged to close the first switch $S_1$ in response to the signal, thereby to connect the controller 16 to the first power source 18, to energize the controller in response to the input signal from the timer.

14 Claims, 3 Drawing Sheets

ELECTRICAL POWER CONTROL SYSTEM FOR PARKING METER

INSTRUCTION AND BACKGROUND

The invention relates to parking meters and more particularly to electronic parking meters.

Known electronic parking meters are powered by rechargeable batteries located in the parking meter housing and/or solar cells provided on the parking meter housing. It will be appreciated that the power consumption, in use, of a parking meter must be as low as possible, so that the meter may function properly over an extended period of time. Furthermore, the lower the power consumption of the essential electronic modules of the meter, the more additional and user friendly electronic features may be added to the parking meter.

A relatively low power consumption electronic parking meter is disclosed in U.S. Pat. No. 4,823,928 to Pom Incorporated. In this parking meter there is used a controller in the form of a microprocessor for controlling the operation of the meter and which microprocessor has a power-up mode, a standby mode and an operational mode. The microprocessor of the meter is normally in stand-by mode and is always connected to the power supply of the meter. An oscillator for providing the microprocessor with a clock or timing signal is also permanently connected to the power supply and is continuously operational. However, when the microprocessor is in the aforementioned stand-by mode, a frequency divider circuit at an output of the oscillator is deactivated so that the clock signal is not provided to the microprocessor. When a coin is placed into the meter, the microprocessor changes to the operational mode and the divider circuit allows the clock signal through to the microprocessor. In the standby mode, the microprocessor and associated logic circuitry described in the preferred embodiment of the invention forming the subject of that patent, draw about 40 μA from the power supply.

OBJECT OF THE INVENTION

It is an object of the applicant's invention to provide an alternative electronic parking meter which the applicant believes may also be very power efficient.

SUMMARY OF THE INVENTION

According to the invention there is provided a token operable electronic parking meter comprising:

a first power source;

a controller for controlling electronic circuitry of the parking meter;

an interface circuit connected to the first power source and for controlling provision of power from the first power source to the controller;

in use, the controller normally being not connected to a power source and being connectable to the first power source via first switch means which is controllable by the interface circuit; and timer means arranged to generate a signal when power is required by the controller;

the interface circuit being sensitive to a signal from said timer means and being arranged to close the first switch means in response to the signal, thereby to connect the controller to the first power source, to energise the controller in response to the input signal from said timer means.

Thus, the controller is only connected to a power supply in the form of the first power source when it is required to perform a function. For the balance of the time it is not connected to the power source, so that it does not draw any current or power.

The timer means may comprise a real time clock and a second power source for proving the timer means with power. The timer means may also comprise an electronic memory arrangement.

In a preferred embodiment of the invention the timer means comprises a device produced and offered for sale by Dallas Semiconductor under the trade name "Touch Memory" and catalogued under number DS 1994.

The parking meter preferably comprises a housing wherein the first power source in the form of a rechargeable battery is located. The housing may be adapted removably to receive a cash box and the aforementioned device may be located in the cash box.

The parking meter may further comprise user instruction input means comprising a set of bay selection buttons provided on the housing of the parking meter, to enable selection, in use, of one of a plurality of parking bays associated with the parking meter; the interface circuit also being sensitive to a signal from said user instruction input means and being responsive To close the first switch means.

The aforementioned electronic circuitry may comprise token detection means and token validation means also connectable to the first power source via said first switch means. Upon actuation of one of said set of bay selection buttons, the interface circuit causes the first switch means to close, thereby to provide the controller, the token detection means and the token validation means with power from the first power source.

The token detection means may be arranged to detect tokens deposited into the meter and the token validation means may be arranged to screen a token received to provide the controller with signals representative of a denomination of the token.

The controller may comprise a microprocessor and may be programmed to transmit to the device data, representative of a time period of parking in e bay selected, corresponding to said denomination of the token received; and the data may be stored in the memory arrangement of the device; whereafter the first switch means is opened by the controller.

The device may then time out the said time period of parking in the bay selected and may then generate and transmit a signal to the interface circuit to cause the interface circuit to close the first switch means, thereby to connect the controller to the first power source.

The controller may be programmed, after having been connected to the first power source as aforesaid to cause one indicator of an array of time expiry indicators and which indicator is associated with the bay selected, to be energised.

The timer means may comprise a real time clock and may be arranged periodically to cause the interface circuit to close the first switch means, thereby to provide the controller with power; and the controller may be arranged then to update a display to display the time of day.

BRIEF DESCRIPTION OF THE DIAGRAMS

The invention will now further be described; by way of example only, with references to the accompanying diagrams wherein.

DESCRIPTION OF A PREFERRED-EMBODIMENT OF THE INVENTION

Figure 1:
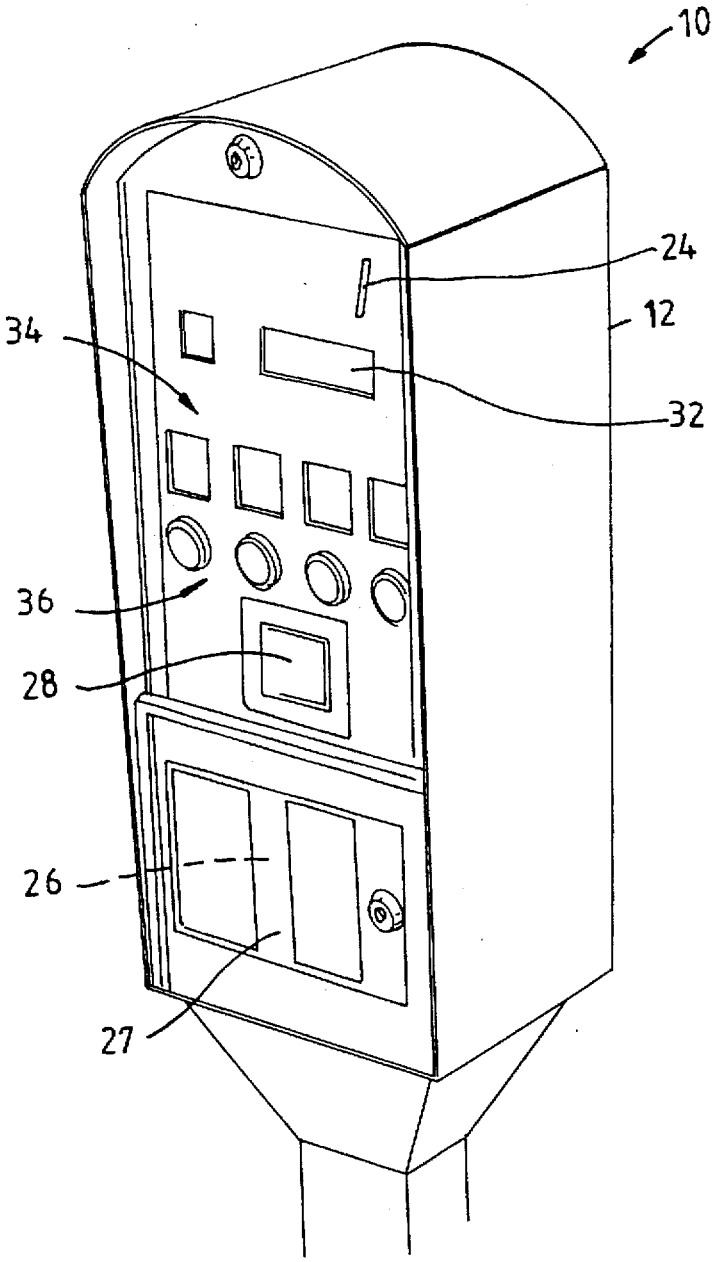
FIG. 1 is a diagrammatic perspective view of a parking meter housing.

An electronic parking meter 10 according to the invention comprises a housing 12 shown in FIG. 1.

Figure 2:
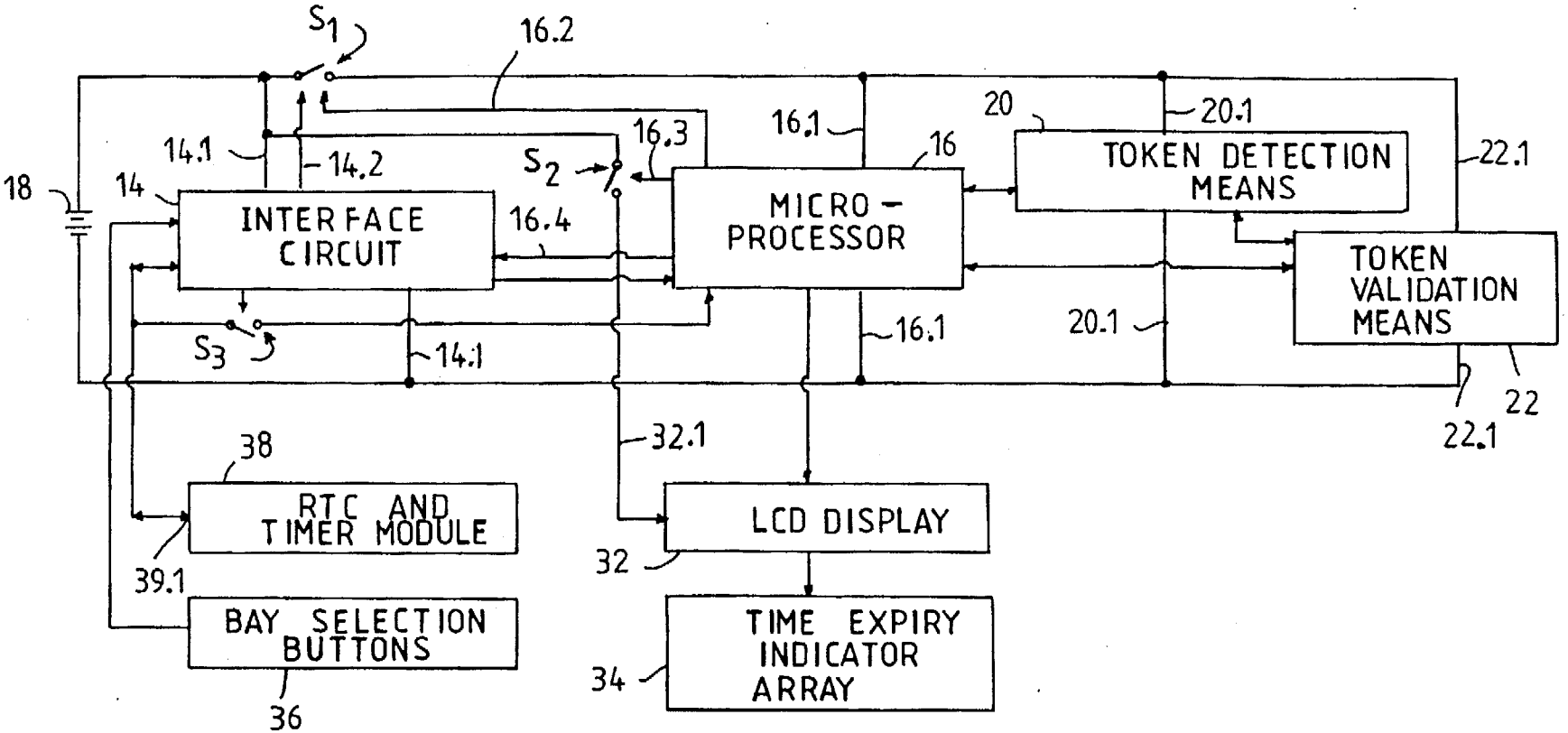
FIG. 2 is a block diagram of relevant power providing and control circuitry of the parking meter.

In the housing 12 there are located an interface circuit 14 and a controller in the form of a microprocessor 16, both shown in FIG. 2. A first and main source of electrical power in the form of a battery 18 is located in a top region of the housing 12. The interface circuit 14 is permanently connected to battery 18 via power lines 14.1.

However, microprocessor 16 is normally not connected to battery 18, but is connectable to the battery 18 via first switch $S_1$, and power lines 16.1 as will be described hereinafter, Switch $S_1$ is controllable by the interface circuit 14 and the microprocessor 16 via control lines 14.2 and 16.2 respectively. Token detection means 20 located in a token chute extending between a token slot 24 (shown in FIG. 1) and a cash box 26 or a reject cup 28 is also connectable to the battery 18 via switch $S_1$ and power lines 20.1. Token validation means 22 (shown in FIG. 2) located in or adjacent the aforementioned chute is also connectable to the battery through switch $S_1$ and power lines 22.1, Cash box 26 is removably housed in housing 12 behind bottom door 27.

Both the token detection means 20 and token validation means 22 as well as a LCD display 32-and a time expiry indicator array 34, shown in FIGS. 1 and 2, are connected to the microprocessor 16 to be in data communication therewith and/or to be controlled thereby, LCD display 32 and the array of time expiry indicators 34 are connectable to battery 18 via switch $S_2$ and power line 32.1. Switch $S_2$ is controllable by microprocessor 16 via control line 16.3

Bay selection buttons 36 (shown in FIGS. 1 and 2) are provided on the parking meter housing 12 and are connected as one set of inputs to the interface circuit 14. The parking meter 10 is a four bay parking meter and the bay selection buttons 36 are used by a prospective user to select one of the four bays associated with the meter and which, in use, are located in the vicinity of the meter. Time expiry indicator array 34 comprises a time expiry indicator associated with each of these bays.

Figure 3:
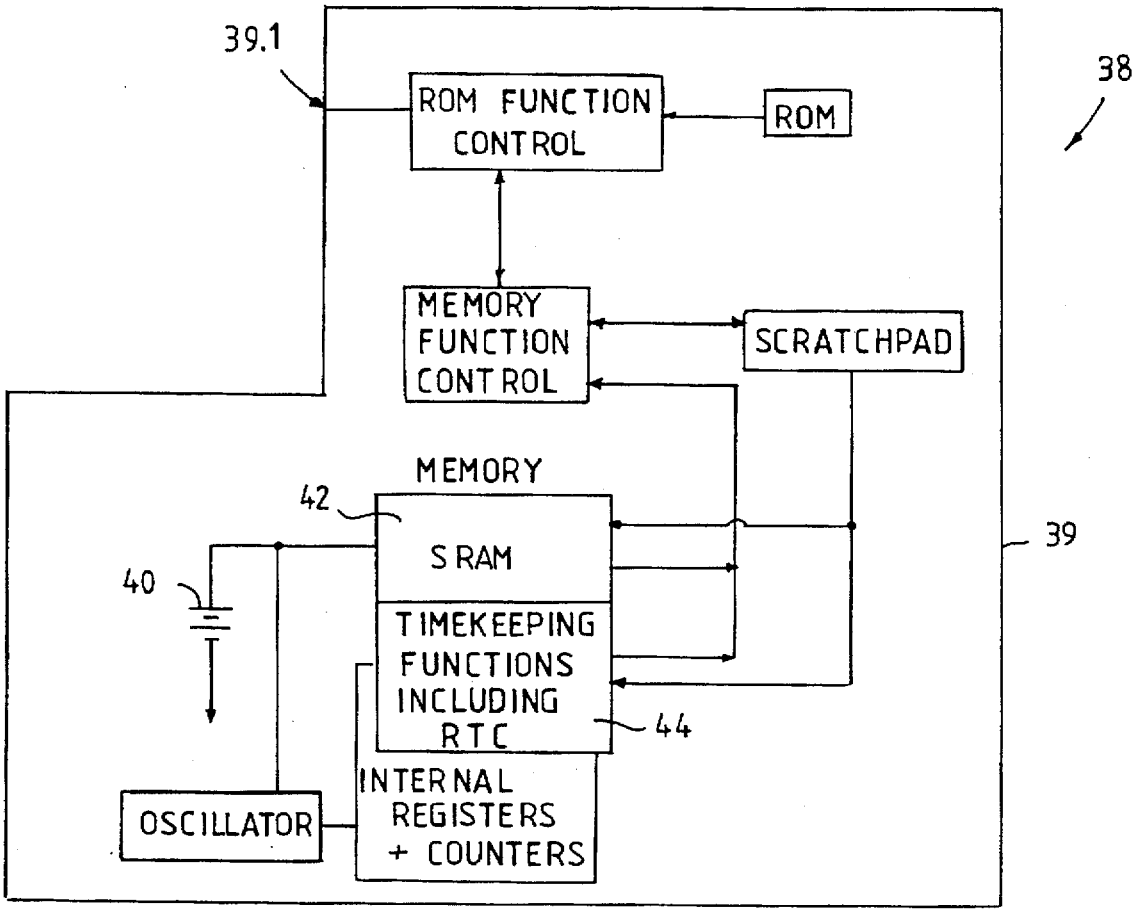
FIG. 3 is a block diagram of an independently powered real time clock, timer end memory device forming part of the circuitry in FIG. 2.

In the cash box of the parking meter 10 there is housed an independently powered real time clock (RTC), timer and memory device 38. Device 38 preferably is in the form of the device produced and offered for sale by Dallas Semiconductor under the trade name "Touch Memory" and catalogued under number DS1994. As shown in the block diagram of the device 38 in FIG. 3, the device comprises its own housing, in the form of a stainless steel case 39. In the case 39 there are located an independent power source 40, a memory arrangement 42 and a real time clock (RTC) 44. The aforementioned devices are known to have a lifetime of in the order of 10 years, before it has to be replaced. The device is connected via a lid contact 39.1 as another input to the interface circuit 14 and is selectively connectable to the microprocessor 16 via switch $S_3$.

Interface circuit 14 comprises logic circuitry, preferably in the form of a flip-flop, to detect signals from the bay selection buttons 36 and the device 38, while the microprocessor is not connected to power and software associated with the microprocessor 16 is thus not running.

In use, device 38 is commissioned and synchronised at a remote control station. After it has been fitted into the cash box 26 of the parking meter 10, it runs continuously on its aforementioned own power source 40. Its timing and calender features are utilised to cause microprocessor 16 to ensure that switch $S_1$ is and remains open, for example, during free parking periods and to disable via line 16.4 sensitivity of the interface circuitry 14 to bay selection buttons 36, during these periods.

At the start of a business period, module 38 enables interface circuit 14 and interface circuit 14 is then sensitive to actuation of the bay selection buttons 36. Interface circuit 14 also causes microprocessor 16 to close switch $S_2$ to provide the display 32 and time expiry indicator array 34 with power from battery 18. Switch $S_2$ remains closed until the end of the business period when it is opened again. During the business period, device 38 periodically sends signals to the interface circuit 14 to cause the latter to close switch $S_1$ to connect the microprocessor 16 to the battery 18. Microprocessor 16 then periodically updates the display, to display the actual time of the day or any other relevant information. After the aforementioned updating, the microprocessor 16 causes switches $S_1$ to open. This procedure is repeated periodically, for example every 60 seconds.

When a user activates one of The bay selection buttons 36 to select one of the four bays for parking, interface circuit 14 causes switch $S_1$ to close. Accordingly, the microprocessor 16, token detection means 20 and token validation means 22 are connected to the battery 18. The token validation means 22 then screens a token received to provide the microprocessor 16 with signals from which the microprocessor determines the denomination of the token and the time period paid for by the user for parking in the selected bay, The microprocessor 16 then transmits data relating to the time period paid for by the user to device 38 via closed switch $S_3$ and this data is then stored in a memory 42 of the device 38. Thereafter, switch $S_1$ is opened again by microprocessor 16, After the time period paid for by the user has been timed out by the device 38, device 38 transmits a signal to interface circuit 14 which causes the interface circuit 14 to close switch $S_1$ to energize the microprocessor 16. The microprocessor 16 then activates a time expiry indicator from the array 34 associated with the bay.

It will be appreciated that the microprocessor 16, token detection means 20 and token validation means 22 are only provided with power when they are required to perform certain functions. For the balance of the time they are not connected to the battery 18, thereby drawing no power from the battery.

It will be appreciated that there are many variations in detail on the parking meter according to the invention, without departing from the scope and spirit of the appended claims.

We claim:

1. A token operable electronic parking meter comprising:

a first power source;

a controller for controlling electronic circuitry of the parking meter;

an interface circuit connected to the first power source and for controlling provision of power from the first power source to the controller;

the controller normally being completely disconnected from said first power source and being connectable to the first power source via first switch means which is controllable by the interface circuit; and timer means arranged to generate a signal when power is required by the controller;

the interface circuit being sensitive to a signal from said timer means and being arranged to operate the first switch means in response to the signal, thereby to connect the controller to the first power source, to energize the controller in response to the input signal from said timer means.

2. A parking meter as claimed in claim 1 wherein the timer means comprises a real time clock and a second power source providing the timer means with power.

3. A parking meter as claimed in claim 1 wherein the timer means comprises an electronic memory arrangement.

4. A parking meter as claimed in claim 3 wherein the timer means comprises a Touch Memory device.

5. A parking meter as claimed in claim 4 comprising a housing, the first power source comprising a battery which is located in the housing, the housing being adapted removably to receive a cash box and the device being located in the cash box.

6. A parking meter as claimed in claim 1 comprising user instruction input means comprising a set of bay selection buttons provided on a housing of the parking meter, to enable selection of one of a plurality of parking bays associated with the parking meter in use; the interface circuit also being sensitive to a signal from said user instruction input means end being responsive to close the first switch means.

7. A parking meter as claimed in claim 6 wherein the electronic circuitry comprises token detection means and token validation means and wherein, upon actuation of one of said set of bay selection buttons, the interface circuit causes the first switch means to close, thereby to provide the controller, the token detection means and the token validation means with power from the first power source.

8. A parking meter as claimed in claim 7 wherein the token detection means is arranged to detect tokens deposited into the meter and the token validation means is arranged to screen a token received to provide the controller with signals representative of a denomination of the token.

9. A parking meter as claimed in claim 8 wherein the timer means comprises a Touch Memory device comprising an electronic memory arrangement; wherein the controller is programmed to transmit to the device data, representative of a time period of parking in a bay selected, corresponding to said denomination of the token received; wherein the data is stored in the memory arrangement of the device; and wherein the first switch means is then opened by the controller.

10. A parking meter as claimed in claim 9 wherein the device times out the said time period of parking in the boy selected and then generates and transmits a signal to the interface circuit to cause the interface circuit to close the first switch means, thereby to connect the controller to the first power source.

11. A parking meter as claimed in claim 10 wherein the controller, after having been connected to the first power source, causes one indicator of an array of time expiry indicators and which indicator is associated with the bay selected, to be energised.

12. A parking meter as claimed in claim 1 wherein the electronic circuitry comprises an electronic display and a time expiry indicator arrangement, the display and time expiry indicator arrangement being connectable to the first power source via a second switch means which is controllable by the controller, the display and time expiry indicator arrangement being connected to the controller to be in data communication with the controller and to be controlled thereby.

13. A parking meter as claimed in claim 12 wherein the timer means comprises a real time clock and is arranged periodically to cause the interface circuit to close the first switch means, thereby to provide the controller with power; and wherein the controller then causes the display to display the time of day.

14. A parking meter as claimed in claim 2 wherein the timer means comprises an electronic memory arrangement.

* * * * *